United States Patent [19]

Van der Scheer et al.

[11] Patent Number: 4,935,711

[45] Date of Patent: Jun. 19, 1990

[54] ELECTROMAGNETIC SWITCH

[75] Inventors: Derk Van der Scheer, Goor; Johannes T. Hopman; Jan W. Hoekstra, both of Hengelo, all of Netherlands

[73] Assignee: Holec Systemen En Componenten B.V., Netherlands

[21] Appl. No.: 291,255

[22] Filed: Dec. 28, 1988

[30] Foreign Application Priority Data

Dec. 31, 1987 [NL] Netherlands ..... 8703170

[51] Int. Cl.[5] ..... H01H 67/02

[52] U.S. Cl. ..... 335/131; 335/6

[58] Field of Search ..... 335/35, 6, 167–176, 335/131–133

[56] References Cited

U.S. PATENT DOCUMENTS 2,883,488 4/1959 Curzon .

4,808,952 2/1989 Berner et al. ..... 335/35

FOREIGN PATENT DOCUMENTS 0127784 12/1984 European Pat. Off. .

1284511 12/1988 Fed. Rep. of Germany .

866591 4/1941 France .

*Primary Examiner*—Leo P. Picard

*Assistant Examiner*—Lincoln Donovan

*Attorney, Agent, or Firm*—Watson, Cole, Grindle & Watson

[57] ABSTRACT

An electromagnetic switch with a housing provided with at least one magnet system, comprising a stator body of magnetic material having an oblong chamber accomodating a movable armature of magnetic material, with an exciter winding for the excitation of a magnetic field in the at least one magnet system. A swingably supported first arm which can be brought into motion under the influence of the excited magnetic field. To actuate a pair of contacts a swingably supported second arm is provided and on each of the first and second arms one end of at least one leaf spring acts. The first and second arms extend on either side of the chamber at right angles to the lengthwise direction thereof in such a way that each of them can swing about their support point in the direction of the armature which is movable in the chamber between the arms. The free end of the first arm is coupled to the armature, which has an operating element which acts on the second arm.

37 Claims, 2 Drawing Sheets

ELECTROMAGNETIC SWITCH

BACKGROUND OF THE INVENTION

The invention relates to an electromagnetic switch with a housing provided with at least one magnet system, comprising a stator body of magnetic material with an exciter winding for the excitation of a magnetic field in the at least one magnet system, a swingably supported first arm which can be brought into motion under the influence of the excited magnetic field, at least one pair of contacts, and a leaf spring system acting upon the first arm.

1. Technical Field of the Invention

An electromagnetic switch of this type is known from U.S. Pat. Specification No. 2,883,488.

In practice, electromagnetically operable switches are used on a wide scale. Besides the application for the remote closing or opening of electric circuits, switches of this type are also used for the protection of electric circuits. Typical areas of application are zero voltage protection, forward and backward current protection, magnetic overload protection and earth leakage protection. To meet the specific switching functions of each of these areas of application, among others mechanical spring systems are used.

For example, spring systems are used, inter alia, for producing the force by means of which the contacts of the pair of contacts are held against each other (closed) or held apart (open) in order to meet specific conditions (thresholds) under which the contacts have to open or close, for producing a desired switching speed, etc. Leaf spring systems are advantageous in that a compact mechanical construction can be realized therewith.

However, the switch construction according to the said U.S. Patent Specification has insufficient facilities to meet the switching functions desired for the abovementioned areas of application. Therefore, this known type of switch has a very limited field of application.

Other electromagnetic switches of this type known in practice generally having fairly complex spring systems with helical draw or compression springs, in conjunction with various switching arms and levers, for example such as described in French Patent Specification No. 866,592.

The various arms, levers and springs are usually fixed by one end to the housing or the chassis of the switch, so that the forces excerted on the pair of contacts also act on various points of the housing or the chassis, which are thereby usually loaded asymmetrically. In particular, in the case of switches for switching off short circuit currents in electrical installations, a high switching speed is required, which means that large powerful springs must be used. The fixing of the springs to the housing or the chassis will often necessitate a heavier structure and addition means, in order to obtain sufficient sturdiness, which means that the number of parts and the size of the switch generally increase as a higher switching speed is required.

A spring for achieving a particular switching function, for example producing a sufficiently high contact force, often has an adverse effect on another switching function such as, for example, the contact opening speed. An additional requirement is therefore generally that the spring action must be degressive. This means that the action of the spring system for producing one switching function must decrease very rapidly when another spring for another switching function goes into action and in some cases even must reverse in direction of action. In order to achieve such a degressive spring action, it is also necessary to have a relatively complex assembly of springs and levers which take up a large amount of space, such as disclosed in European Patent Application No. EP-A-127,784.

The object of the present invention is therefore to provide for an electromagnetic switch with a minimum of parts, and having a compact structure taking up little space, with which a large number of switching functions desired in practice, including short-circuit protection and overload protection (delayed/instantaneous switching) can be achieved.

2. Discussion of the Related Art

This is achieved according to the invention in that to actuate the pair of contacts a swingably supported second arm is provided, on each of said first and second arms one end of at least one leaf spring acts, the stator body having an oblong chamber accommodating a movable armature of magnetic material, said first and second arms extending on either side of the chamber at right angles to the lengthwise direction thereof in such a way that each of them can swing about their support point in the direction of the armature which is movable in the chamber between the arms, while the free end of the first arm is coupled to the armature, which has an operating element which acts on the second arm.

The placing of the armature between the first and second arm of the leaf spring system means that, by varying the swinging properties of one and/or the other arm, the movement of the armature as a result of the electromagnetic force exerted thereon can be set within wide limits. This means that the switching features of the switch can also be adapted with a great measure of freedom to the specific requirements set by a particular application. For example, with the first arm a desired threshold action against putting the armature into motion can be achieved, and with the second arm, independently of the action of the first arm, a desired force for holding the contacts against each other can be set.

Due to the mutual arrangement of the various moving parts of the switch according to the invention, the latter is both simple in design and compact in construction, and it can be dimensioned for a large number of specific purposes. Since the switch according to the invention also has a minimum of parts, the chances of failures either during fitting or in operation are much lower than in the case of switches of this type known in practice.

A preferred embodiment of the electromagnetic switch according to the invention is constructed in such a way that the stator body is approximately U-shaped in cross section, in which the chamber extends from one leg to the other, the leaf spring system is fixed to the stator body in such a way that the first and second arms each extend along a leg thereof, and the chamber and the legs are provided with passages through which the first arm is coupled to the armature and the operating element can act on the second arm, respectively, while the exciter winding is disposed around the chamber.

All moving switch parts are supported here by the stator body, so that no other connection points to the housing are necessary, other than the fixing points of the stator body itself. It will be clear that this is very attractive from the production point of view.

Another embodiment of the invention is characterized in that the armature is fixed to the first arm by means of a hinge connection and the operating element acting on the second arm is a pin connected to the armature, by means of which the second arm can be moved.

Yet another embodiment of the electromagnetic switch according to the invention is characterized in that the leaf spring system consists of a supporting frame with one leaf spring, each end of which acts respectively on the first and second arms situated in the frame aperture and supported by the supporting frame, the dimensions of said arms in the frame aperture being such that the leaf spring is tensioned, so that under the influence of the spring action of the leaf spring essentially a threshold action is obtained with the first arm against taking of the at least one pair of contacts into the one position and with the second arm essentially contact force is obtained for holding the pair of contacts in the other position.

Yet a further embodiment of the switch according to the invention is characterized in that the leaf spring system comprises a supporting frame with two leaf springs extending in such a way from an end at which they are supported by the supporting frame that the free ends of said leaf springs point in opposite directions, each free end acting on the first and second arms situated in the frame aperture and supported by the supporting frame, respectively, the dimensions of said arms in the frame aperture being such that the two leaf springs are tensioned so that with the spring action of the one leaf spring and the first arm influenced thereby essentially a threshold action is obtained against taking of the at least one pair of contacts into the one position, and with the spring action of the other leaf spring and the second arm influenced thereby essentially contact force for holding the at least one pair of contacts in the other position is obtained.

This embodiment has the advantage that the action of the first and second arms can be set in the optimum manner, independently of each other, since each of them is influenced by a separate leaf spring.

The swinging properties of an arm of the leaf spring system can be adapted in a relatively simple manner by selecting their support position and the action position of the at least one leaf spring thereon suitably relative to each other, this being of course partly dependent on the spring characteristics of the leaf spring itself. The leaf spring system is set forth in U.S. Ser. No. 291,257filed Dec. 28, 1988, and commonly owned herewith.

Since with a leaf spring system of this type such great forces can be exerted on the arms that not only sufficiently high switching speed, but also sufficiently high contact force can be achieved, the switch according to the invention can be used advantageously for switching off short circuit currents in, for example, electrical installations. An explosion chamber is often used in practice for extinguishing any discharge arc which may occur during separation from each other of the contacts of the pair of contacts of the switch. Yet another embodiment of the switch according to the invention, in which the at least one pair of contacts comprises a movable and a fixed contact, is for this purpose characterized in that the fixed contact is fixed to the inlet aperture of an explosion chamber accommodated in the housing, while the free end of the second arm contains the movable contact which can move in the inlet aperture of the explosion chamber.

The inlet of the explosion chamber in this construction is directly opposite the place of origin of the discharge arc, which promotes the extinguishing action thereof. A further improvement of the extinguishing action is obtained according to the invention through the fact that the explosion chamber is shaped so that it widens out from the inlet aperture, the wide part thereof containing the extinguishing means.

Yet another embodiment of the switch according to the invention which, in consequence of the high switching speed achievable therewith, in the order of magnitude of a fraction of the period duration of the alternating voltage to be switched off, can also be used advantageously as a current-limiting switch in electrical energy distribution plants, is characterized in that the switch has at least one current-limiting component, the connecting ends of which are connected to the respective contacts of the at least one pair of contacts. As a result of the very compact construction of the magnet system, this at least one current-limiting component can advantageously be housed in the housing of the switch. This current-limiting component is preferably a resistor, but can also be a reactance coil, or can consist of a combination of one or more resistors, reactance coils and/or capacitors.

Such a current-limiting switch is in practice always used in conjunction with a switch also accommodated upstream in the plant and has the advantage that the current of the electrical plant is only limited and is not interrupted. In the event of a short circuit and/or if there is a certain measure of overloading, the contacts of the current-limiting switch, which are normally closed under the effect of the spring action, are opened, so that the at least one current-limiting component is switched in series with the consumers connected to the plant. Through suitable dimensioning of the current-limiting component, the particular short-circuit or overload current is limited, after which this limited current is switched off by the said switch upstream housed in the plant. Since this further switch need not switch off the complete short-circuit current, its construction can be simpler, and it is thus less prone to failures than switches which have to be able to switch off a complete short circuit current.

If in accordance with a preferred embodiment of the switch according to the invention a connecting end of the exciter winding is connected to a contact of the at least one pair of contacts and the other connecting end of the exciter winding together with the other contact forms the connecting points of the switch, the limited current still continues to flow through the exciter winding. When a switch such as that constructed according to the invention is used, it is necessary for it to have a certain degree of hysteresis. This means that the current intensities at which the pair of contacts is moved from one position to the other and vice versa must be different. For example, when it is used as a current-limiting switch, the pair of contacts must open above a certain current intensity and must close at a current intensity lower than the limited current value.

In order to ensure that the switch goes into operation only at a particular intensity of the current in the exciter winding, a certain threshold action against taking the pair of contacts from one position to the other must be achieved. In the electromagnetic switch according to the invention, this can be achieved either by a suitable selection of the force applied by the at least one leaf spring on the first arm or by a suitable construction of the magnetic circuit of the magnet system.

In order to ensure that the pair of contacts generally returns again to a particular state at a current intensity which is lower than the current intensity necessary for taking it out of this position, an embodiment of the electromagnetic switch according to the invention is further characterized in that means are provided for limiting the travel of at least one of the arms in such a way that the total of forces exerted on the arms under the influence of the at least one leaf spring are always directed in the opposite direction to the forces which can be exerted on the arms under the influence of the armature.

Another embodiment of the electromagnetic switch according to the invention is to this end characterized in that a stop of magnetic material for limiting the travel of the armature is disposed in the chamber near the end situated opposite the second arm. With the same object, yet another embodiment of the invention is characterized in that another stop for limiting the travel of the second arm is provided in the housing.

Through the limitation of the travel of the armature, the travel of the first arm connected thereto and with the further stop the travel of the second arm can be limited in such a way that when the switch is energized, in other words, when the pair of contacts is moved from one position to the other under the influence of the generated electromagnetic force, the resultant of the forces exerted on the arms by the spring system is always such that it maintains a certain value which is opposite to the electromagnetic force of the magnet system. The stop accommodated in the chamber also has an effect on the magnetic action of the magnet system, which can be understood as follows.

In one position of the pair of contacts, for example if the contacts are resting against each other, there is an air gap of specific dimensions, and with a specific magnetic resistance, between the armature and the stop. In order to move the armature in the direction of the stop, the electromagnetic force generated by the current in the exciter winding will have to have a sufficiently high value to overcome this magnetic resistance, in addition to the threshold force exerted by the leaf spring system. When the armature has moved against the stop, so that the pair of contacts is open, the current through the exciter winding will be reduced by the electric arc occurring, but in particular in the embodiment with a current-limiting component. Since there is now no air gap between the armature and the stop in the chamber, this lower current is sufficient to hold the armature against the stop. If the current through the exciter winding now decreases further in such a way that the electromagnetic force becomes smaller than the force exerted by the spring system on the armature, the armature is moved under the influence of the spring action in the direction away from the stop, so that the pair of contacts closes again. It will be clear that the envisaged hysteresis and threshold action are determined both by the force exerted by the spring system on the armature and by the dimensions of the air gap.

In order to permit holding of the contact pair in a particular position, for example after switching, the second arm can according to the invention be locked in a known manner in such a way that the pair of contacts can be moved to the other position, for example simply by releasing the lock by hand.

The invention will now be explained with reference to two embodiments and the attached drawings.

BRIEF DESCRIPTION OF THE DRAWINGS

FIG. 3 shows in graph form the resulting force exerted by the spring system on the armature as a function of the displacement of the operating element connected thereto and acting on the second arm.

DETAILED DESCRIPTION OF THE PREFERRED EMBODIMENTS

Figure 1:
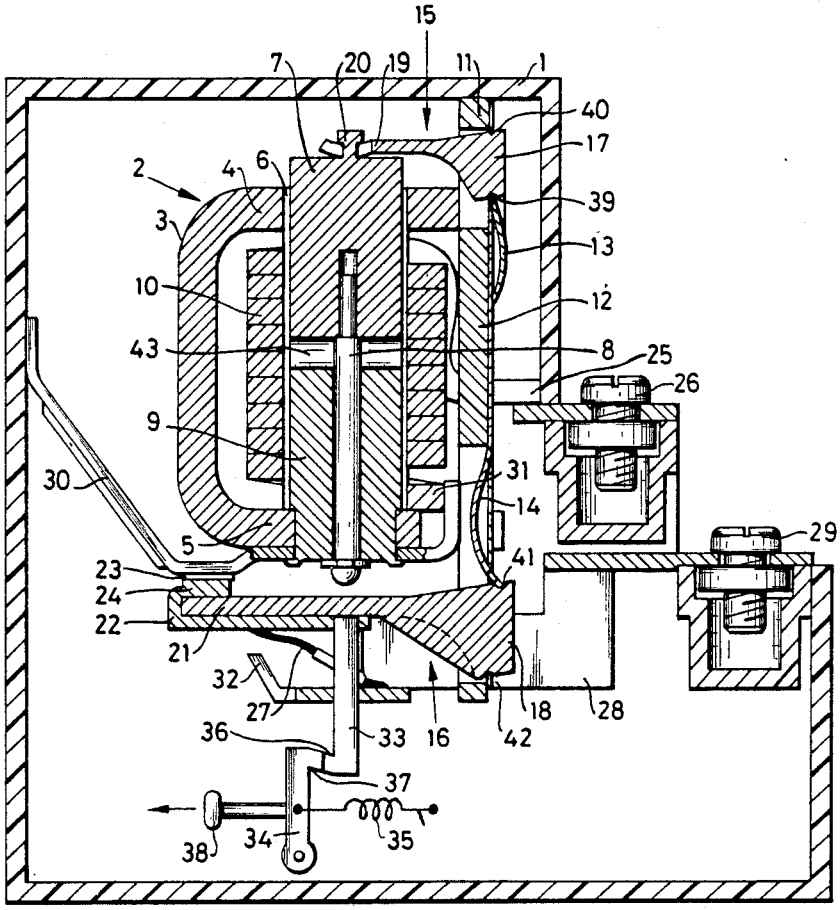
FIG. 1 shows schematically in cross section an embodiment of an electromagnetic switch according to the invention.

FIG. 1 shows schematically a cross section of an electromagnetic switch constructed according to the invention, having a housing 1 and a magnet system 2.

The magnet system 2 consists of a U-shaped stator body 3 of magnetic material, containing a cylindrical chamber 6 extending from the one leg 4 to the other leg 5 of the stator body 3. The two legs 4, 5 of the stator body 3 have at the chamber 6 a passage through which at the leg 4 a cylindrical-shaped armature 7 of magnetic material can be moved in and out of the chamber 6, and at the leg 5 a pin 8 connected to the armature can extend beyond the chamber 6. A stop 9 of magnetic material is disposed in the chamber 6 at the point where the pin 8 can extend beyond the chamber 6. Said stop 9 has a passage for the pin 8. An exciter winding 10 is provided around the chamber 6. The magnet system 2 is fixed to the housing 1 by means of a stator plate 11 fitted on the ends of the legs 4, 5 of the stator body 3.

A leaf spring system, constructed in accordance with FIG. 5*d* of the above-mentioned U.S. patent application No. 291,257, filed by applicants simultaneously with the present application, is fixed on the stator plate 11. The leaf spring system comprises a supporting frame 12 with two leaf springs 13, 14 which are each supported at one end by the supporting frame 12 and point in opposite directions, each free end of the leaf springs 13, 14 acting on the arm parts 17, 18—situated in the frame aperture and tiltably supported by the supporting frame 12—of a first arm 15 and a second arm 16 respectively. The arm parts 17, 18 are of a shape which is adapted to the circumstances and of such dimensions that the respective leaf springs 13, 14 are tensioned and are thus slightly curved in shape.

The first arm 15 extends through an aperture in the stator plate 11 along the leg 4 of the stator body 3, through which the armature 7 can project outside. The free end 19 of the arm 15 is of such a shape that it can be hingedly connected to the armature 7. This can be, for example, a screw connection 20, but it can also be a forked connection or the like. The second arm 16 also extends through an aperture in the stator plate 11 along the leg 5 of the stator body 3, through which a pin 8 connected to the armature can project outside. The arm 16 is provided with moving contact 24, for example in the form of an electrically conducting layer 22 which runs through over the free end 21 thereof and which at the side of the arm 16 facing the stator body 3 ends opposite a fixed contact 23.

The connecting end 25 of the exciter winding 10 is connected to the terminal 26, and the movable contact 24 is connected to the terminal 29 by means of the flexible connection 27 and the electrically conducting layer 22 disposed on the contact arm 16 and the electrically conducting supporting plate 28. The fixed contact 23 is mounted on the electrically conducting support 30, and via this support 30 is fixed to the other connecting end 31 of the exciter winding 10.

A stop 32 by means of which the travel of the arm 16 can be limited is disposed at a distance from the side of the second arm 16 facing away from the stator body 3. As shown in FIG. 1, a first locking hook 33 is connected to the arm 16, which like the arm 15 can be either of electrically conducting or of insulating material (plastic), said locking hook being capable of mating with a second locking hook 34 for locking the second arm 16 when the pair of contacts is in the open state.

The second locking hook 34 is fixed, with rotatable support at one end, on the housing 1. At the free ends the two locking hooks are provided with mating trapezoidal hook parts. In the illustrated closed position of the pair of contacts 23, 24 the two hook parts are held against each other, as shown, by means of the draw spring 35 fixed on the housing 1 and the second locking hook 34.

In the locked position the straight sides 36, 37 of the hook parts engage with each other and the lock can be removed only by moving the operating button 38, which is connected to the second locking hook 34 and is accessible from the outside of the housing, against the spring action of the draw spring 35 (direction of the arrow), after which the arm 16 returns, under the influence of the leaf spring 14 acting thereon, to the position shown.

The action of the switch is now as follows. The spring action of the leaf spring 13 and the arm 15 influenced by it exerts essentially a threshold action against taking of the pair of contacts 23, 24 into the one (not shown, open) position, while the leaf spring 14 and the arm 16 influenced thereby essentially delivers the contact force for holding the pair of contacts in the closed position shown.

A clockwise couple is exerted by means of the leaf spring 13 on the first arm 15 and by means of the leaf spring 14 on the second arm 16. This can be achieved simply because the action point 39 of the leaf spring 13 on the arm part 17 of the arm 15, looking in the plane of the drawing, lies left of the support point 40 where the arm part 17 is supported by the supporting frame 12. The opposite situation applies to the second arm 16. Here, the action point 41 of the leaf spring 14, looking in the plane of the drawing, lies right of the support point 42 where the arm part 18 is supported by the supporting frame 12. The action points 39, 41 and the support points 40, 42 are formed as V-shaped notches in the respective arm parts 17, 18.

In the situation shown in the drawing the second arm 16 is held with its movable contact 24 against the fixed contact 23 under the influence of the couple acting upon it. The armature 7 is partially moved out of the chamber 6 under the influence of the first arm 15. An air gap 43, representing a specific magnetic resistance, is provided between the armature 7 and the stop 9. As the current through the exciter winding 10 increases, the electromagnetic force thereby generated 14 will also increase, and the armature 7 will want to move in a direction towards the stop 9. When the electromagnetic force has reached such a value that the force thereby acting on the armature 7 is greater than the force exerted by the first arm 15 in the opposite direction, the armature 7 will be moved against the stop 9. Through the movement of the pin 8 in the direction of the second arm 16, an anticlockwise couple, viewed in the plane of the drawing, is exerted thereon, so that the pair of contacts 23, 24 is opened and locked in this position by means of the locking hooks 33, 34.

The intensity of the current through the exciter winding 10 at which the pair of contacts is opened can thus be set either by the size of the air gap 43 or by the spring action of the spring system. It goes without saying that the locking of the switch can be achieved in many different ways known in practice and can be dispensed with if necessary. Instead of opening of the contacts, it is possible, for example by disposing the fixed contact 23 and the movable contact 24 on the side of the second arm 16 facing away from the stator 3, to transform the switch to a switch which closes contacts under the influence of a particular current intensity. The connecting end 31 of the exciter winding and the fixed contact 23 must then be taken to the outside on separate terminals (not shown).

In the above-mentioned leaf spring system the respective leaf springs 13, 14 with their supported ends are integral with the supporting frame 12. It is, however, also possible to use detachably supported leaf springs, or leaf springs which do not extend in line with each other, such as shown, for example, in FIG. 5*a* of the above-mentioned U.S. patent application No. 291,257, filed by applicant simultaneously with the present application. The supporting frame 12 can also be formed by the stator plate 11, by providing the latter with suitable support points for the arms 15, 16.

The electromagnetically operated switch according to the invention, as shown in FIG. 1, is suitable for use, for example, as an overload safety switch, where the current to be switched off has such a value that an explosion chamber is not necessary.

Figure 2:
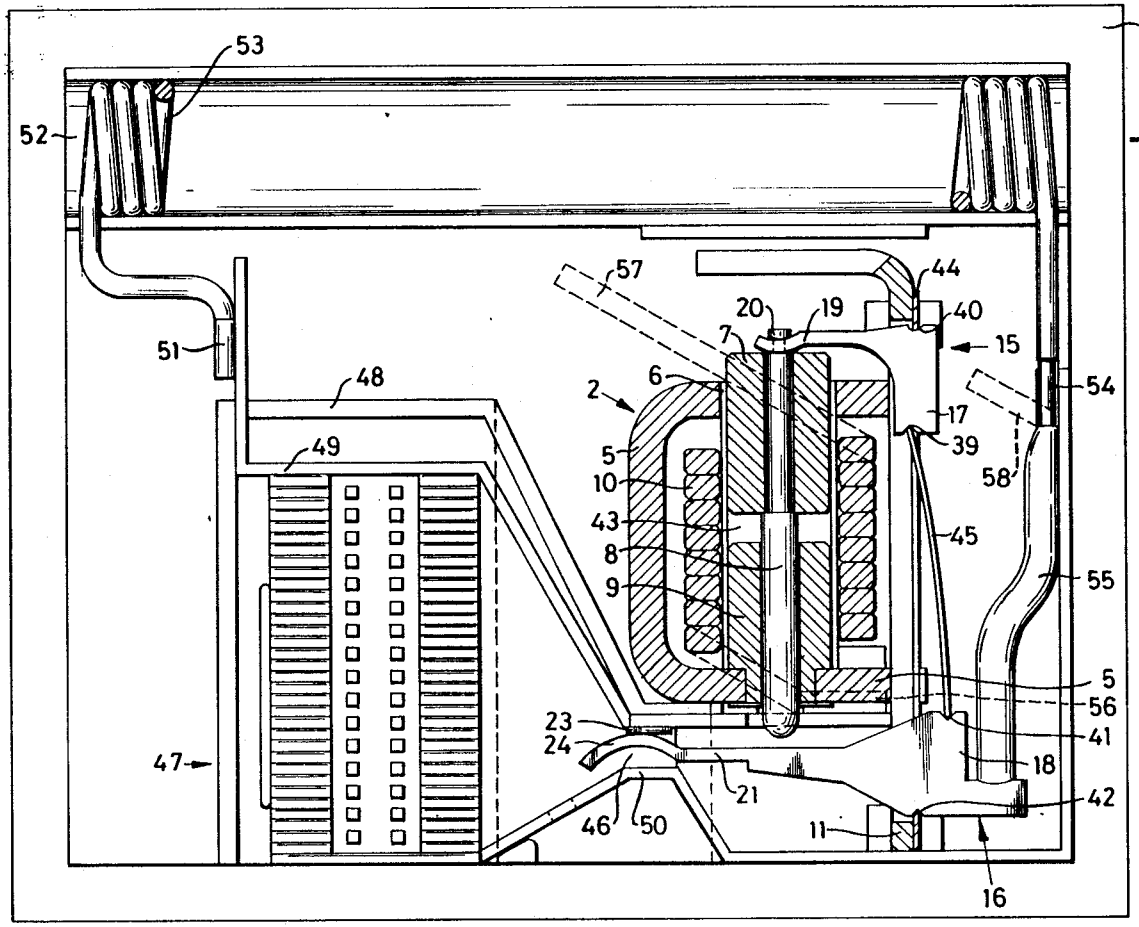
FIG. 2 shows schematically in cross section another embodiment of an electromagnetically operated switch according to the invention which can be used as a current-limiting power-cutout switch in electrical distribution plants.

FIG. 2 shows schematically in cross section a further embodiment of an electromagnetically operated current-limiting switch according to the invention, making use of a spring system with only one leaf spring, in accordance with FIG. 6*c* of the above-mentioned Netherlands patent application No. 8703173, filed by applicant simultaneously with the present application. The parts in FIG. 2 which have a similar function to that of the parts shown in FIG. 1 are indicated by the same reference numbers.

The leaf spring system comprises a supporting frame 44 and a single leaf spring 45. The first arm 15 and the second arm 16 are disposed between the ends of the leaf spring 45 and the opposite edges of the supporting frame 44 respectively. The dimensions of the arm parts 17, 18—supported in the frame aperture—of the first arm 15 and the second arm 16 respectively are such that the leaf spring 45 is tensioned and thus slightly curved when in the fitted state. The arm parts 17, 18 supported in the frame aperture are of a shape which is adapted to the circumstances and can be virtually rectangular.

The pair of contacts 23, 24 is in the inlet aperture 46 of an explosion chamber 47, which is shaped so that it widens out asymmetrically from the inlet aperture. The explosion chamber 47 is disposed within a space formed by a wall 48 and the housing 1 and is provided with known means for extinguishing any discharge arc between the pair of contacts 23, 24. The explosion chamber 47 is positioned directly opposite the place of origin of the discharge arc, so that together with the narrowing inlet aperture 46 an effective action for extinguishing of a discharge arc is obtained. The bounding wall of the explosion chamber 47 can be provided, for example at the pair of contacts 23, 24, with a stop 50 which limits the travel of the arm 16.

One contact end 51 of a resistor 53, made up of helically wound resistor wire and situated in the space 52, is connected to the fixed contact 23 via the electrically conducting wall 49 of the explosion chamber. The other connecting end 54 of the resistor 53 is connected by means of a flexible, electrically conducting connection 55 to the electrically conducting arm 16, at the end 21 of which the movable contact 24 is formed. A connecting end 56 of the exciter winding 10 is also electrically connected to the fixed contact 23 via the continuous wall 49 of the explosion chamber, as shown by dotted lines. The other connecting end 57 of the exciter winding 10, also shown by dotted lines, together with the connecting end 58, which is connected in electrically conducting fashion to the connecting end 54 of the resistor 53 and via the flexible connection 55 to the movable contact 24, shown by dotted lines, forms the connecting points of the current-limiting switch, which can be provided, for example according to FIG. 1, on terminals.

As already discussed in the introduction, it is possible instead of a current-limiting resistor 53, also to accommodate a reactance coil or a combination of one or more resistors, reactance coils and/or capacitors in the housing 1.

A discharge arc occurring during the separation of the contacts is extinguished in an effective manner by the explosion chamber 47. When the pair of contacts 23, 24 is open, the limiting resistor 53 is in the current circuit, so that the current flowing through the switch circuit is reduced to a predetermined value. The spring system is dimensioned in such a way that during the time that this limited current is flowing through the switch circuit the electromagnetic force thereby generated is strong enough to hold the armature 7 against the stop 9. Since in this situation the air gap 43 is reduced to zero, a smaller magnetic force will do to hold the armature 7 attracted than that needed to take it into the attracted state. The travel of the second arm 16 can be limited in such a way, for example, by means of the stop 50, that the leaf spring 45 does not go through its transition point, so that it constantly exerts a clockwise couple, viewed in the plane of the drawing, on the arm 16. The action points 39, 41 for the leaf spring and the support points 40, 42 of the arm parts 17 and 18 respectively are positioned in a similar way relative to each other as shown in FIG. 1.

FIG. 3 indicates roughly in graph form the resulting force exerted by the leaf spring system on the armature 7 as a function of the displacement of the pin 8 connected to the armature 7. The path x travelled by the pin 8 is plotted along the horizontal axis, and the above-mentioned resulting force F is plotted along the vertical axis. Since this is a graph purely for illustrative purposes, no units or numerical value are indicated for x and F.

The position of the pin 8 shown in FIG. 1 and in FIG. 2 corresponds to the point $x_o$ in FIG. 3. Assuming that no current is flowing through the exciter winding, the value $F_1$ of the resulting force F acting on the armature in the direction of the first arm 15 corresponds to the threshold force exerted by the leaf spring system. If subsequently an electromagnetic force under the influence of a current flowing in the exciter winding is exerted on the armature 7 for moving it in the direction of the second arm 16, the armature will be moved in the direction of the second arm 16 when the value $F_1$ is thereby exceeded.

As a result of the degressive action of the leaf spring system, the force exerted on the armature 7 when the pin 8 is moved decreases until at point $x_1$ the pin 8 knocks against the second arm 16. The resulting force of the leaf spring system exerted on the armature 7, which had fallen to a value $F_2$, now increases abruptly under the influence of the force acting thereon through the second arm 16 until it reaches a value $F'_2$. The movement of the pin in the region $x_o$–$x_1$ is called the free stroke. Although the decrease in the force F in this region is indicated as a straight line part 60, it can also be a curved line part, depending on the spring action of the leaf spring system exerted on the first arm 15.

If, under the influence of the electromagnetic force acting thereon, the armature 7 is moved further in the direction of the stop 9, the resulting force F exerted on the armature by the two arms 15 and 16 decreases to a value $F_3$ as a result of the degressive action of the leaf spring system, for example according to the line part 61 shown in FIG. 3. The course of the (linear) decrease in the resulting force F indicated by the line part 61 is essentially determined by the characteristics of the leaf spring and the position of the action and support points of the respective arm parts 17 and 18 and can also have a non-linear development. The degressive action of the leaf spring system arises through the fact that through the movement of the first arm 15 and/or the second arm 16 the current position of their respective action points 39 and 41 relative to the matching support points 40, 42 changes, so that the current couple arms of the leaf spring system change. Through the change in the couple arms, the couples exerted on the arm 15 and/or the arm 16 change, which delivers the final degressive spring action of the leaf spring system.

At the point $x_2$ the armature 7 runs against the stop in the chamber 6, and the influence of the force exerted by the first arm 15 is suddenly eliminated. Since the force exerted by this first arm 15 on the armature 7 has itself changed direction in the region between $x_1$ and $x_2$, as shown by the broken line 62 extending in the bottom half plane of the graph, the resulting force F acting on the armature at point $x_2$ will increase abruptly to a value $F'_3$.

From the point $x_2$ the second arm 16 then swings through to the point $x_3$, as a result of its kinetic energy. In the graph this can be seen as a virtual displacement of the pin 8. The point $x_3$ is determined by the further stop 32 (FIG. 1) or 50 (FIG. 2) situated in the housing or by another suitable limitation of the travel of the second arm 16. The decrease in the resulting force F indicated by the line part 63 is determined by the degressive spring action exerted on the second arm 16 and can have a non-linear development instead of the linear curve shown. Since in point $x_3$ a resulting force $F_4$ acts on the second arm 16 in the direction of the pin 8, said arm 16 will move towards the pin 8 and will in the end remain resting against the pin 8 in the point $x_2$, so that the pair of contacts 23, 24 is opened.

If now the current in the switching circuit falls in such a way that the force exerted by the leaf spring on the second arm 16 is greater than the force acting thereon from the pin 8 connected to the armature 7, the pair of contacts 23, 24 will be closed again and assume the position shown in FIG. 1 or FIG. 2 again.

If this self-returning position is not intended, the leaf spring system must be dimensioned in such a way that the resulting force F is negative in the region $x_2$–$x_3$, thus comes in the bottom half plane of the graph, which in FIG. 1 and FIG. 2 means that the leaf spring system exerts a righthand couple on the second arm 16, so that said arm 16 remains resting against the stop 32 or 50 respectively.

The hysteresis action of the switch referred to in the introduction is essentially determined by the length of the air gap 43 in the lengthwise direction of the chamber 6, the positioning of the action points 39, 41 of the respective arm parts 17, 18 and the characteristics of the leaf spring 45. A shifting of the action points 39, 41 relative to the plane of the supporting frame 44 leads to a different spring action. In order to retain the desired couple directions, it is, however, necessary for the action point 39 of the leaf spring 45 on the arm part 17 in one direction and the action point 41 of the leaf spring 45 on the arm part 18 in the other direction to remain displaced in such a way relative to the respective support points 40, 41 that the leaf spring 45 is always tensioned and is, for example, curved in a direction away from the stator body 3, as shown in FIG. 2. The dimensions of the air gap 43 are determined by the length of the armature 7 and the length of the stop 9 measured in the lengthwise direction of the chamber 6.

If the switch is used, for example, in electrical plants with a nominal voltage of 220 V, and the current-limiting resistor 53 has, for example, a value of 1 Ohm, when a complete short circuit occurs, i.e. with a short-circuit resistance equal to zero, after the pair of contacts 23, 24 of the current-limiting switch has opened due to the short circuit current occurring and any discharge arc is extinguished, leaving aside the ohmic resistance of the exciter winding 10 and the circuit behind it, a limited current of about 220A will flow through the switch circuit. The magnet system 2 of the current-limiting switch must now be dimensioned in such a way that the armature 7 remains attracted by this limited current, i.e. the pair of contacts 23, 24 remains open. Only when the short circuit is switched off, for example by another switch accommodated in the plant, may the pair of contacts 23, 24 be closed again. It goes without saying that the resistor 53 must be dimensioned in such a way that it must be capable of taking the power developed therein during the period of time that a short-circuit situation prevails. The space 52 in which the resistor 53 is situated can be provided with, for example, suitable ventilation apertures (not shown) for this purpose.

In order to retain the self-setting action of the current-limiting switch, i.e. to ensure that after the elimination of the cause of the opening of the pair of contacts 23, 24 it returns to its predetermined state, in this case with closed pair of contacts 23, 24, suitable stop means other than the stop 50 which together with the fixed contact 23 determines the dimensions of the inlet aperture 46 of the explosion chamber 47 can, of course, also be used, for example bosses and the like (not shown) formed in the housing.

The embodiment of the electromagnetic switch according to the invention shown in FIG. 2, due to the leaf spring system with a single leaf spring, is extremely suitable for switching off relatively high short circuit currents within part of a period of the alternating current. This is because, due to the detachably supported leaf spring 45, the leaf spring system can exert a high contact opening speed and contact force, as described in the abovementioned Netherlands patent application No. 8703173, filed by applicant simultaneously with the present application.

Although in the illustrated embodiments of the electromagnetic switch according to the invention a connecting end of the exciter winding 10 is fixed to a contact of the pair of contacts 23, 24, the switch according to the invention is not, however, restricted to this. The connecting ends of the exciter winding, like the contacts 23, 24, can all be taken to the outside on a terminal, for example such as the terminals 26, 29 of FIG. 1. The stator body 3, the explosion chamber 47 and the current-limiting resistor 53 can, of course, also be designed differently from the embodiment shown in FIG. 2.

It will be clear that the electromagnetically operated switch according to the invention is not limited to the embodiments thereof shown and described, but that many modifications and expansions can be made by an expert, without departing from the scope and idea of the invention.

We claim:

1. An electromagnetic switch, comprising a housing accommodating at least one magnet system, said magnet system comprising:

a stator body of magnetic material;

an oblong chamber having a first and second end, said chamber being supported by said stator body;

a plunger type armature of magnetic material movably accommodated in said chamber;

an exciter winding for the excitation of a magnetic field in the stator body and armature for the actuation thereof;

a first and second arm, pivotably supported, arranged on the first and second end of said chamber, respectively, and extending at approximately right angles to the lengthwise direction of the chamber, such that each arm can swing about a support in the direction to and from the corresponding end of the chamber, the first arm being mechanically coupled to the armature;

a pair of contacts operatively associated with the second arm;

an operating elements coupled to the armature for actuating the second arm to operate on said pair of contacts; and at least one leaf spring system acting upon said first and second arms near the support thereof, said at least one leaf spring system being fixed to the stator body.

2. An electromagnetic switch according to claim 1, wherein the stator body is approximately U-shaped in cross-section, between the legs of which the chamber extends form one leg to the other, the exciter winding being disposed around the chamber, the first and second arms each extend along a leg of the stator body, and the first and second ends of the chamber and the legs are provided with passages through which the first arm is coupled to the armature and the operating element can act on the second arm, respectively.

3. An electromagnetic switch according to claim 1, further comprising means for limiting the travel of at least one of the arms such that the total of forces exerted on the arms under the influence of the at least one leaf spring are always directed in the opposite direction to the forces to be exerted on the arms by the armature.

4. An electromagnetic switch according to claim 3, wherein a stop of magnetic material for limiting the travel of the armature is disposed in the chamber near the second end thereof.

5. An electromagnetic switch according to claim 4, wherein another stop for limiting the travel of the second arm is provided in the housing.

6. An electromagnetic switch according to claim 1, wherein the armature is fixed to the first arm by means of a hinge connection and the operating element acting on the second arm is a pin connected to the armature, by means of which the second arm can be brought into motion.

7. An electromagnetic switch according to claim 1, wherein the at least one leaf spring system consists of a supporting frame, having a frame aperture and one leaf spring having a first and second end, the first and second arms being oppositely arranged in the frame aperture and supported by the supporting frame at a boundary edge of the frame aperture, said one leaf spring acting with its first and second end on the first and second arms, respectively, the dimensions of said arms and the leaf spring measured in the frame aperture being such that the leaf spring is tensioned, so that under the influence of the spring action of said leaf spring essentially a threshold action is obtained with the first arm against taking of the at least one pair of contacts from a first into a second position, and with the second arm essentially contact force is obtained for holding the pair of contacts in the second position.

8. An electromagnetic switch according to claim 7, wherein the action point of the first end of the leaf spring on the first arm and the action point of the second end of the leaf spring on the second arm are displaced relative to the respective support points of said first and second arm by the supporting frame in one and another direction transverse to the supporting frame, respectively.

9. An electromagnetic switch according to claim 1, wherein the at least one leaf spring system comprises a supporting frame having at least one frame aperture and two leaf springs, each of said leaf springs having a first and second end, the first and second arms being oppositely arranged and supported by the support frame at a boundary edge of the at least one frame aperture, said leaf springs each being supported by the supporting frame at their first ends, the second ends of said leaf springs pointing in opposite direction for acting on the first and second arms, respectively, the dimensions of said arms and the leaf springs measured in the frame aperture being such that the leaf springs are tensioned so that under the influence of the spring action of the one leaf spring acting on the first arm essentially a threshold action is obtained against taking of the at least one pair of contacts from a first position in a second position and under the influence the spring action of the other leaf spring acting on the second arm essentially a contact force for holding the at least one pair of contacts in the second position is obtained.

10. An electromagnetic switch according to claim 7 or 9, wherein the pair of contacts is open in the first position and closed in the second position.

11. An electromagnetic switch according to claim 1, wherein the at least one pair of contacts comprises a movable and a fixed contact, the fixed contact being arranged at the inlet aperture of an explosion chamber accommodated in the housing, and the free end of the second arm contains the movable contact movably arranged in the inlet aperture of said explosion chamber.

12. An electromagnetic switch according to claim 11, wherein said explosion chamber is shaped so that it widens out from the inlet aperture, the widened part thereof containing extinguishing means.

13. An electromagnetic switch according to claim 1, wherein said exciter winding is connected at a connecting end to a contact of said at least one pair of contacts, and another connecting end of said exciter winding and another contact of said pair of contacts form electrical connecting points of said switch.

14. An electromagnetic switch according to claim 1, wherein said switch has at least one current-limiting component having connecting ends respectively connected to the contacts of said at least one pair of contacts.

15. An electromagnetic switch according to claim 14, wherein said at least one current-limiting component comprises a reactance coil.

16. An electromagnetic switch according to claim 14, wherein said at least one current-limiting component comprises a resistor.

17. An electromagnetic switch according to claim 16, wherein said resistor comprises a helically wound resistor wire situated in an oblong space formed in the housing of said switch.

18. An electromagnetic switch according to claim 1, wherein said second arm is provided with operable locking means for holding the pair of contact in a particular position.

19. An electromagnetic switch, comprising a housing accommodating at least one magnet system, said magnet system comprising:

a stator body of magnetic material;

an oblong chamber having a first and second end, said chamber being supported by said stator body;

a plunger type armature of magnetic material movably accommodated in said chamber;

an exciter winding for the excitation of a magnetic field in the stator body and armature for the actuation thereof;

a first and second arm, pivotably supported, arranged on the first and second end of said chamber, respectively, and extending at approximately right angles to the lengthwise direction of the chamber, such that each arm can swing about a support in the direction to and from the corresponding end of the chamber, the first arm being mechanically coupled to the armature;

a pair of contacts operatively associated with the second arm;

an operating elements coupled to the armature for actuating the second arm to operate on said pair of contacts; and at least one leaf spring system acting upon said first and second arms near the support thereof, said at least one leaf spring system being fixed to the stator body;

wherein the stator body is approximately U-shaped in cross-section with two legs, the chamber extends between the legs from one leg to the other, the exciter winding being disposed around the chamber, the first and second arms each extend along a leg of the stator body, and the chamber and the legs are provided with passages through which the first arm is coupled to the armature and the operating element can act on the second arm, respectively.

20. An electromagnetic switch according to claim 2, further comprising means for limiting the travel of at least one of the arms such that the total of forces exerted on the arms under the influence of the at least one leaf spring are always directed in the opposite direction to the forces to be exerted on the arms by the armature.

21. An electromagnetic switch according to claim 20, wherein a stop of magnetic material for limiting the travel of the armature is disposed in the chamber near the second end thereof.

22. An electromagnetic switch according to claim 21, wherein another stop for limiting the travel of the second arm is provided in the housing.

23. An electromagnetic switch according to claim 1, wherein the armature is fixed to the first arm by means of a hinge connection and the operating element acting on the second arm is a pin connected to the armature, by means of which the second arm can be brought into motion.

24. An electromagnetic switch according to claim 1, wherein the at least one leaf spring system consists of a supporting frame, having a frame aperture and one leaf spring having a first and second end, the first and second arms being oppositely arranged in the frame aperture and supported by the supporting frame at a boundary edge of the frame aperture, said one leaf spring acting with its first and second end on the first and second arms, respectively, the dimensions of said arms and the leaf spring measured in the frame aperture being such that the leaf spring is tensioned so that under the influence of the spring action of said leaf spring essentially a threshold action is obtained with the first arm against taking of the at least one pair of contacts from a first into a second position, and with the second arm essentially contact force is obtained for holding the pair of contacts in the second position.

25. An electromagnetic switch according to claim 24, wherein the action point of the first end of the leaf spring on the first arm and the action point of the second end of the leaf spring on the second arm are displaced relative to the respective support points of said first and second arm by the supporting frame in one and another direction transverse to the supporting frame, respectively.

26. An electromagnetic switch according to claim 1, wherein the at least one leaf spring system comprises a supporting frame having at least one frame aperture and two leaf springs, each of said leaf springs having a first and second end, the first and second arms being oppositely arranged and supported by the support frame at a boundary edge of the at least one frame aperture, said leaf springs each being supported by the supporting frame at their first ends, the second ends of said leaf springs pointing in opposite direction for acting on the first and second arms, respectively, the dimensions of said arms and the leaf springs measured in the frame aperture being such that the leaf springs are tensioned so that under the influence of the spring action of the one leaf spring acting on the first arm essentially a threshold action is obtained against taking of the at least one pair of contacts from a first position in a second position and under the influence the spring action of the other leaf spring acting on the second arm essentially a contact force for holding the at least one pair of contacts in the second position is obtained.

27. An electromagnetic switch according to claim 24, wherein the pair of contacts is open in the first position and closed in the second position.

28. An electromagnetic switch according to claim 1, wherein the at least one pair of contacts comprises a movable and a fixed contact, the fixed contact being arranged at the inlet aperture of an explosion chamber accommodated in the housing, and the free end of the second arm contains the movable contact movably arranged in the inlet aperture of said explosion chamber.

29. An electromagnetic switch according to claim 27, wherein said explosion chamber is shaped so that is widens out from the inlet aperture, the widened part thereof containing extinguishing means.

30. An electromagnetic switch according to claim 1, wherein said exciter winding is connected at a connecting end to a contact of said at least one pair of contacts, and another connecting end of said exciter winding and another contact of said pair of contacts form electrical connecting points of said switch.

31. An electromagnetic switch according to claim 1, wherein said switch has at least one current-limiting component having connecting ends respectively connected to the contacts of said at least one pair of contacts.

32. An electromagnetic switch according to claim 30, wherein said at least one current-limiting component comprises a reactance coil.

33. An electromagnetic switch according to claim 30, wherein said at least one current-limiting component comprises a resistor.

34. An electromagnetic switch according to claim 32, wherein said resistor comprises a helically wound resistor wire situated in an oblong space formed in the housing of said switch.

35. An electromagnetic switch according to claim 1, wherein said second arm is provided with operable locking means for holding the pair of contacts in a particular position.

36. An electromagnetic switch according to claim 2, further comprising means for limiting the travel of at least one of the arms such that the total of forces exerted on the arms under the influence of the at least one leaf spring are always directed in the opposite direction to the forces to be exerted on the arms by the armature.

37. An electromagnetic switch according to claim 26, wherein the pair of contacts is open in the first position and closed in the second position.

* * * * *